United States Patent [19]

Galowitz

[11] 4,214,684

[45] Jul. 29, 1980

[54] BALL HOLDER

[76] Inventor: Dennis A. Galowitz, 1020 S. Fifth St., Stillwater, Minn. 55082

[21] Appl. No.: 957,792

[22] Filed: Nov. 6, 1978

[51] Int. Cl.[2] ..... B65D 61/00

[52] U.S. Cl. ..... 224/45 L; 224/919; 224/50; 211/14; 248/316 R; 206/315 B

[58] Field of Search ..... 224/45 L, 45 G, 45 R, 224/45 S, 50, 51; 211/14, 15, 33, 37, 49 R, 49 S; 248/309 R, 316 R, 316 A, 316 B, 316 C; 206/315 R, 315 B

[56] References Cited

U.S. PATENT DOCUMENTS

| | | | |
|---|---|---|---|
| 2,341,635 | 2/1944 | Loesch | 211/59 |
| 2,443,684 | 6/1948 | Lazarus | 211/74 |
| 2,448,171 | 8/1948 | Campbell | 224/50 |
| 2,826,333 | 3/1958 | Rodemich | 224/45 G X |
| 3,355,027 | 11/1967 | Gibbons | 211/14 |

FOREIGN PATENT DOCUMENTS

| | | | |
|---|---|---|---|
| 1003806 | 3/1952 | France | 224/45 L |
| 1309754 | 10/1962 | France | 224/45 L |
| 379864 | 4/1940 | Italy | 224/45 L |
| 10277 | of 1906 | United Kingdom | 211/59 |

*Primary Examiner*—Robert J. Spar
*Assistant Examiner*—Jerold M. Forsberg
*Attorney, Agent, or Firm*—Merchant, Gould, Smith, Edell, Welter & Schmidt

[57] ABSTRACT

An improved rack for holding a plurality of balls in a compact array comprises a plurality of planar support members. These support members are carried on two elongated vertical rods for movement as a unit. The support members have a plurality of ball receiving recesses and can be spaced apart with the balls being received in aligned recesses on adjacent support members. Springs surrounding the rods bear against the support members to force them together to firmly retain the balls in place. However, the support members can be moved against the force of the springs to allow the balls to be placed in or removed from the rack.

14 Claims, 3 Drawing Figures

BALL HOLDER

TECHNICAL FIELD

This invention relates to an apparatus for holding a plurality of separate spherical objects such as balls in a compact manner for convenient transportation of the balls as a group. More particularly, the apparatus of this invention is also constructed to allow the balls to be easily placed in or removed from the apparatus.

BACKGROUND OF THE PRIOR ART

Many sports and recreational games use spherical balls as part of the equipment of the game. One well-known example of such a game is croquet which uses a number of small wooden balls as part of the equipment thereof. Recently, a game which is known as boccie ball has become increasingly popular in the United States. Boccie ball has been popular for a number of years in other countries, most notably Italy where the game apparently originated. The game of boccie ball is a form of lawn bowling played in a relatively long and narrow court. The equipment for boccie ball includes eight relatively large balls of a first diameter and a second smaller ball of a second and smaller diameter.

To the best of Applicant's knowledge, the boccie ball sets which have been marketed have included no convenient means for storing or transporting the boccie balls themselves. Once the original package has been opened, each user of the boccie ball set has had to find his own particular system or apparatus for storing the balls. Typically, the balls are simply placed into an open box which box must be picked up to carry the balls from one location to another. The balls are, of course, free to roll around in the box making such an apparatus sometimes burdensome and inconvenient to use.

Various racks or holders have been developed over the years for holding diverse types of objects. With regard to spherically shaped objects, such as balls, U.S. Pat. Nos. 2,756,901 to Cowsert and 3,908,825 to Ayoub et al are interest. These patents disclose devices in which the balls are generally held in vertically elongated rows with one ball resting on top of the other. Each row of balls is usually held between a base plate and an openable or removable cover at the other end of the row. However, these carriers are somewhat inconvenient to use in that each ball or object must be stacked or unstacked from the row individually. This can be a burdensome operation when the rows are deep. Furthermore, since each of the balls rests in contact with other balls, there is always the possibility that dropping the balls in the row will cause the balls to chip or otherwise be damaged.

U.S. Pat. No. 3,198,338 discloses a display rack for holding bowling balls. The display rack includes a plurality of vertically spaced turntables molded from plastic and having seats in which the bowling balls rest. However, the rack disclosed in this patent is not suitable for the situation where the balls should be transported from one location to another. This is so because the balls are not confined in the rack but only rest in their seats for display.

French Pat. No. 1,003,806 discloses a ball holder having two identical halves pivotted together along one side. The ball holder has two large recesses for holding two large balls and a small recess for holding a small ball. While the holder disclosed in this patent is capable of transporting the balls, a holder designed such as this for use in carrying the nine balls used in boccie ball would be quite large and bulky. This size problem would increase both the expense of manufacturing the holder and also the difficulty which a user would encounter in carrying the holder.

BRIEF SUMMARY OF THE INVENTION

Accordingly, one aspect of this invention relates to an apparatus for carrying a plurality of balls in a convenient manner but which allows the balls to be quickly and easily removed from the holder. Another aspect of this invention is the provision of such a holder which is simple and inexpensive.

The ball holding apparatus of this invention comprises three spaced support members or disks each having suitable means for receiving and holding the balls therebetween. The support members are spaced apart by the balls in a vertical array and are connected to a support frame which interrelates the support members together. The support frame comrises two support rods which extend upwardly through the support members. A suitable means for imposing a force on the support members tending to force these members together is provided. This force allows the spaced support members to firmly and securely support the boccie balls. However, this force can also be overcome by hand pressure to increase the spacing between the support members allowing the boccie balls to be removed.

DETAILED DESCRIPTION OF THE DRAWINGS

Figure 2:
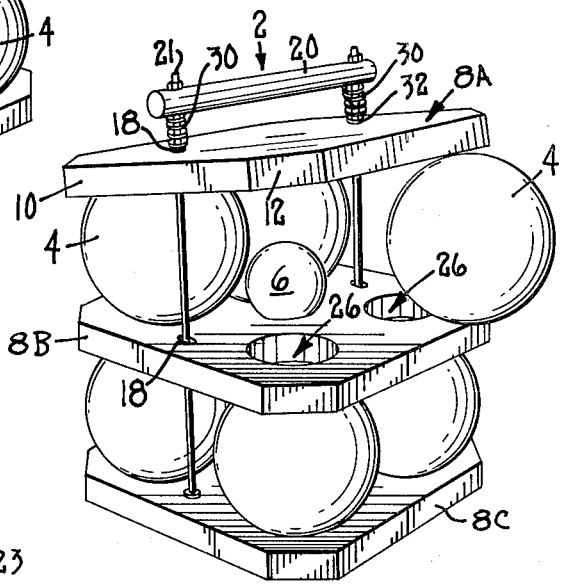
FIG. 2 is a perspective view of the apparatus shown in FIG. 1, particularly illustrating the manner in which the support members of the apparatus can be manipulated to allow the boccie balls to be placed in or removed from the apparatus.

Referring now to the drawings, in which like reference numerals refer to like elements throughout, an improved ball holding apparatus or rack according to this invention is generally indicated as 2. Referring to FIG. 2, rack 2 is particularly suited for holding eight balls, generally indicated as 4, of a first diameter in a compact rectangular array. In addition, rack 2 is also designed to hold at least one additional ball of a smaller diameter which ball is indicated as 6. Together, the balls 4 and 6 comprise that set of balls which is used in playing the game of boccie ball. However, rack 2 is not limited for use with just boccie balls, but may be used to support any other type of ball or any similarly shaped spherical objects.

Figure 1:
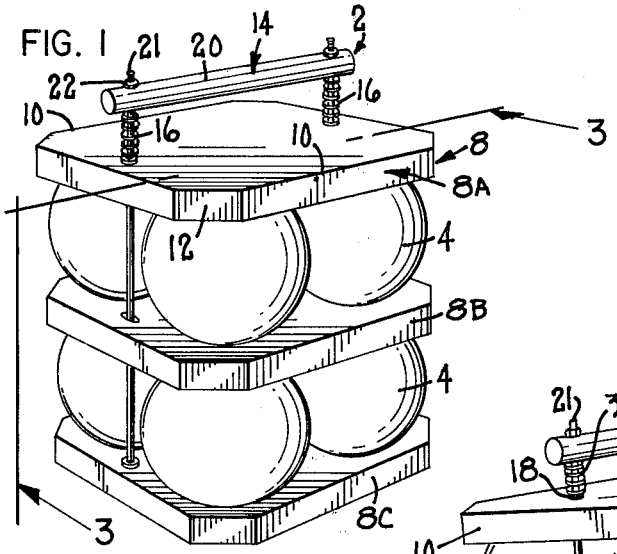
FIG. 1 is a perspective view of an improved ball holding apparatus according to this invention, particularly illustrating the use of the apparatus for holding nine boccie balls.

Rack 2 comprises a set of substantially rigid and planar ball holding support members or disks. The support members are generally indicated in FIGS. 1 and 2 as 8. There are at least two such support members 8 in the set. As shown in the drawings, three such support members are preferably provided. These may be referred to as the top support member 8A, a middle support member 8B, and a bottom support member 8C. Although three such support members have been shown, more than three support members could be used if so desired as will be explained hereafter.

Referring to FIGS. 1 and 2, the support members 8A–8C are identically shaped and are located in a suitable vertical array. Preferably, support members 8A–8C are substantially horizontal and have a plurality of sides 10. The corners 12 of each of the support members 8A–8C are preferably notched or cut away such that the corners of the support members do not come to a point. Such a construction is preferred since a person who accidentally backs into or comes into contact with the support members will not encounter any sharp edges. Support members 8A–8C can be made of any suitably rigid materials. Particle board or other rigid wood materials are preferred material for the support members 8A–8C.

Figure 3:
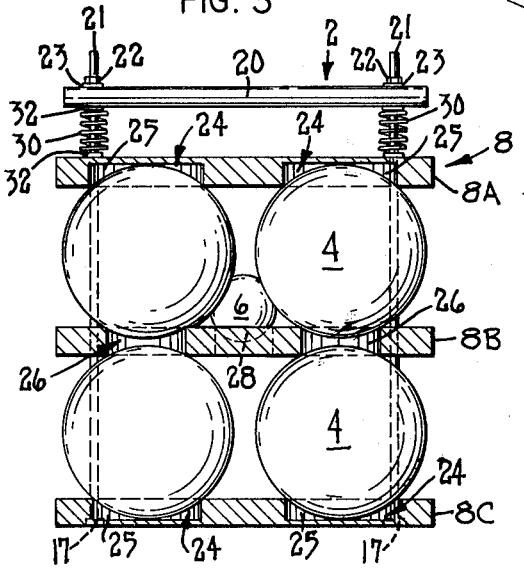
FIG. 3 is a cross-sectional view of the improved ball holding apparatus of FIG. 1 taken along the lines 3—3 of FIG. 1.

Referring to FIGS. 1–3, the support members 8A–8C are interrelated and connected together as a group or unit by means of a support frame generally indicated as 14. Support frame 14 comprises two elongated vertical support rods 16 which pass upwardly through two opposed sides 10 of each of the support members 8A–8C. Support rods 16 are suitably connected at one end (e.g., by a nut 17) to the bottom support member 8C. Rods 16 then pass upwardly through the middle and top support members 8B and 8A. These support members have holes or openings 18 such that the support members 8A and 8B are loosely received on the rods 16.

After the rods 16 have passed through the top support member 8A, they also pass through circular holes in an elongated handle 20. The top ends of the rods are threaded as at 21 for receiving a nut 22 thereon. Nut 22 will be located above the handle 20 with a suitable washer 23 being interposed between each nut 22 and the handle 20. See FIG. 3. Handle 20 serves as a means for carrying the rest of the rack 2 from one location to another.

Each of the support members 8A–8C have suitable means for receiving the balls 4 therebetween. As shown in the figures, these ball receiving means comprise cup shaped ball receiving recesses 24 which will receive an end of a ball 4. The ball receiving recesses 24 in the top and bottom support members 8A and 8C are defined by shallow concave or cylindrical indentations 25 in the support members. Indentations 25 do not pass through the thickness of the support members 8A and 8C. However, the ball receiving recesses 24 in the middle support member 8B may be defined by the top and bottom of circular holes 26 which pass entirely through the thickness of the support member 8B. While it is preferred that the recesses 24 are defined by the holes 26 and indentations 25 shown in FIGS. 1–3, any other suitable means for defining a cup shaped device for holding one side of the ball 4 may be provided. For example, each of the support members 8A–8C would have upwardly extending stands secured to the surfaces thereof which stands define a concave recess. In addition, the middle support member 8B has a circular hole 28 positioned at the center thereof between the four larger holes 26 for the balls 4. Hole 28 is for the purpose of receiving ball 6 as described hereafter.

As illustrated in the drawings, each of the balls 4 may be placed between two opposed support members 8A–8C with each end of the balls 4 being received in one of the cup shaped recesses 24. Preferably, four balls 4 are located in between each set of adjacent ones of the support members 8A–8C. In addition, the ball 6 is located in the opening 28 between the four balls 4 located between the top and middle support members 8A and 8B. The four balls 4 which surround the ball 6 each contact a portion of the ball 6 to firmly retain the ball in place as shown in FIG. 3.

An important feature of this invention is the use of elongated springs 30 located around each of the support rods 16. Springs 30 extend between the handle 20 and the top surface of the top support member 8A and bear against opposed washers 32. These springs 30 exert a downward force on the array of the support members 8A–8C tending to force these support members together. This force securely locks or retains each of the balls 4 in place in the recesses 24 of adjacent support members. However, to remove any of the balls 4 from the rack 2 or to put the balls into the rack, all that is required is that the support members 8A–8C be tilted up against the force of the springs 30 to open up a gap along one side of the rack. See for example the orientation shown in FIG. 2. The user of the rack 2 can then manually remove each of the balls 4 from the opposed recesses 24.

Support members 8A–8C can be tilted as shown in FIG. 2 by hand pressure against the force of the springs 30. Moreover, the support rods 16 do not interfere with this tilting movement. While the rods 16 are substantially rigid, they are also thin enough in relation to their length to be able to flex to some degree allowing the support members 8A–8C to be tilted with regard to one another. In addition, the openings 18 through which the support rods 16 extend could be somewhat elongated to further allow the flexing movement of the support rods 16.

The ball holding rack according to this invention is particularly advantageous. It comprises a convenient apparatus for storing and holding the balls 4 and 6 used in boccie ball. More particularly, the balls 4 and 6 can be quickly and easily placed in or removed from the ball holding rack 2. In addition, the ball holding rack 2 is designed to securely lock or keep the balls in place therein even when the rack is being carried. All these features are accomplished by a rack comprising three planar support members 8A–8C, two rods 16, two springs 30, and a handle 20. Thus, the ball holding apparatus or rack 2 of this invention is not only effective for the purpose for which it is designed, but is also inexpensive to manufacture and/or purchase because of its simplicity.

Springs 30 extending between the handle 20 and the top support member 8A can also have the force exerted thereby adjusted in a quick and simple manner. All that is required is that the nuts 22 be screwed up and down the threaded outer ends 21 of the rods 16 towards or away from the top support member 8A. When the nuts 22 are threaded towards the support member 8A, the handle 20 will also be moved closer compressing the springs 30. Thus, any force exerted by the springs will be increased meaning that relatively greater hand pressure must be used in tilting the support members 8A–8C apart. Thus, the user of the rack 2 can adjust the pressure of springs 30 to any desired degree, as dictated by individual preference.

Various modifications of this invention will be apparent to those skilled in the art. For example, although the support members 8A–8C have been shown to be square or rectangular in shape, this shape could obviously vary. In addition, although it is preferred that the eight balls 4 be located between three spaced support members 8A–8C in two layers of four balls, it would also be possible to adapt the rack to have more support members with a fewer number of balls in each layer. Furthermore, greater or lesser numbers of balls and different sized balls could be supported by the rack 2 as is necessary with adjustment of the number and size of the recesses 24.

As noted previously, an important feature of this invention is that support members 8A–8C are forced together to hold the balls securely therebetween. This force can be achieved using any suitable means. For example, support members 8A–8C could be made of a plastic material in which the material is itself stressed and in which the support members are fixed to a portion of the support frame. Then, in order to remove the balls from the rack 2, support members could be merely bent or flexed along one or more sides against the force inherent in the support members. Then, when the support members are released, they would naturally return to their ball holding position. Similarly, the support members 8A–8C could be forced together by means of a strap or straps extending along one or more sides of the support members. These straps could be tightened to achieve the force necessary for firmly holding the balls 4 and 6. With this latter arrangement, a support frame such as frame 14 may not be strictly necessary. For example, the rack 2 could have the handle or gripping means 20 merely fixedly attached to the top support member 8A, and support members 8A–8C would be held together for movement as a unit only by the straps.

Accordingly, the scope of this invention is to be limited only by the appended claims.

I claim:

1. An apparatus for holding and transporting a plurality of balls or similar objects, which comprises:

(a) a plurality of support members;

(b) means for operatively connecting the support members together for movement as a unit with the support members being stacked on top of one another;

(c) wherein each support member has means for receiving one end of at least one ball, and wherein the ball receiving means on adjacent ones of the support members are aligned with one another such that the balls can be received in the ball receiving means in a vertical array when the adjacent support members are spaced apart;

(d) means for continuously forcing the support members towards one another to firmly retain the balls between the adjacent support members; and (e) wherein the connecting means comprises two spaced, elongated vertical rods which extend upwardly relative to the support members to connect the support members together even when the support members are spaced apart with the balls received therebetween, and wherein at least some of the support members are both vertically movable relative to the rods and are pivotably mounted on the rods for pivotal movement about a substantially horizontal pivot axis extending between the rods against the force of the forcing means, whereby the spacing between the support members may be increased along one side of a support member by pivotting the support member about the pivot axis to allow the balls to be placed in or removed from the ball receiving means.

2. An improved ball holding apparatus as recited in claim 1, in which the forcing means comprises a resilient force applied to the support members.

3. An improved ball holding apparatus as recited in claim 2, in which the support members are spring loaded to move towards one another to hold the ball firmly therebetween.

4. An improved ball holding apparatus as recited in claim 1, in which each support member is substantially planar, and wherein the connecting means comprises two elongated vertical rods which pass upwardly through the support members.

5. An improved ball holding apparatus as recited in claim 4, wherein at least some of the support members are loosely received on the rods for the relative vertical movement of the support members.

6. An improved ball holding apparatus as recited in claim 5, further including gripping means located adjacent one end of the rods for carrying the support members and the ball contained therebetween.

7. An improved ball holding apparatus as recited in claim 6, further including a spring surrounding each rod and extending between the gripping means and one of the support members, wherein the springs define the forcing means for forcing the support members together.

8. An improved ball holding apparatus as recited in claim 4, in which each support member has a plurality of sides, and wherein the rods pass upwardly through the support members adjacent opposed sides thereof.

9. An improved ball holding apparatus as recited in claims 1 or 7, in which each of the support members is substantially rigid.

10. An improved ball holding apparatus as recited in claim 1, in which the ball receiving means on each support member comprises a recess which is suitably shaped for receiving one end of the ball.

11. An improved ball holding apparatus as recited in claim 1, in which each of the support members has a plurality of ball receiving means for respectively holding a plurality of balls between the aligned receiving means of adjacent support members.

12. An improved ball holding apparatus as recited in claim 1, further including means for adjusting the force exerted by the forcing means on the support members.

13. An improved rack for holding a plurality of balls in a compact array, wherein the balls have large and small sizes, which comprises:

(a) at least three substantially planar support members comprising a top, a middle, and a bottom support member, wherein each of the support members are provided with a plurality of ball receiving recesses suited for receiving one end of a ball;

(b) a support frame for holding said support members together and comprising at least one elongated rod which extends generally vertically upwardly through the support members;

(c) means attached to the rod for carrying the support members;

(d) means carried on the support frame for forcing the support members together when the support members are in a vertically spaced apart orientation on the rods such that one ball can be received and retained between any two aligned recesses in opposed support members; and (e) wherein either the middle or bottom support member has ball receiving recesses of large and small sizes for respectively receiving the large and small sized balls, and wherein at least one small recess is located in the middle of the support member between a plurality of large recesses such that the large balls contact and retain the small ball held in place in the small recess.

14. An apparatus for holding and transporting a plurality of balls or similar objects, which comprises:

(a) a plurality of support members;

(b) means for operatively connecting the support members together for movement as a unit with the support members being stacked on top of one another; wherein the connecting means comprises at least two elongated vertical rods which pass upwardly through the support members;

(c) wherein each support member has means for receiving one end of at least one ball, and wherein the ball receiving means on adjacent ones of the support members are aligned with one another such that the balls can be received in the ball receiving means in a vertical array when the adjacent support members are spaced apart;

(d) means for continuously forcing the support members towards one another to firmly retain the balls between the adjacent support members;

(e) wherein at least some of the support members are both movably and pivotably received on the rods for vertical and pivotal movement relative thereto against the force of the forcing means, whereby the spacing between the support members may be increased along one side of the support members by pivoting one support member relative to the rods to allow the balls to be placed in or removed from the ball receiving means;

(f) gripping means located adjacent one end of the rods for carrying the support members and the balls contained therebetween;

(g) a spring surrounding each rod and extending between the gripping means and one of the support members, wherein the springs define the forcing means for forcing the support members together; and (h) wherein the gripping means is longitudinally adjustable along the rods to vary the force exerted by the springs on the support members.

* * * * *